US011679584B2

(12) United States Patent
Peeters et al.

(10) Patent No.: US 11,679,584 B2
(45) Date of Patent: Jun. 20, 2023

(54) FAN ASSEMBLY FOR A CUT SHEET INKJET PRINTER, CUT SHEET INKJET PRINTER AND METHOD FOR OPERATING A FAN ASSEMBLY FOR A CUT SHEET INKJET PRINTER

(71) Applicant: Canon Production Printing Holding B.V., Venlo (NL)

(72) Inventors: Guus M. C. Peeters, Venlo (NL); Hendrikus G. M. Ramackers, Venlo (NL)

(73) Assignee: Canon Production Printing Holding B.V., Venlo (NL)

( * ) Notice: Subject to any disclaimer, the term of this patent is extended or adjusted under 35 U.S.C. 154(b) by 297 days.

(21) Appl. No.: 17/069,687

(22) Filed: Oct. 13, 2020

(65) Prior Publication Data

US 2021/0107275 A1 Apr. 15, 2021

(30) Foreign Application Priority Data

Oct. 14, 2019 (EP) ..... 19203096

(51) Int. Cl.

| | |
|---|---|
| ***B65H 5/22*** | (2006.01) |
| ***B41J 11/00*** | (2006.01) |
| ***B41F 21/06*** | (2006.01) |
| ***B65H 11/00*** | (2006.01) |

(52) U.S. Cl.

CPC ..... *B41F 21/06* (2013.01); *B41J 11/007* (2013.01); *B41J 11/0085* (2013.01); *B65H 11/005* (2013.01); *B65H 2301/44735* (2013.01); *B65H 2801/03* (2013.01)

(58) Field of Classification Search

CPC ... B41J 11/0085; B41J 11/007; B41J 11/0022; B41J 11/00222; B41F 21/06; B65H 2301/44735; B65H 2801/03; B65H 11/005; B65H 5/224; B65H 29/242

See application file for complete search history.

(56) References Cited

U.S. PATENT DOCUMENTS

| | | | |
|---|---|---|---|
| 2006/0001721 | A1 | 1/2006 | Yraceburu et al. |
| 2011/0199447 | A1 | 8/2011 | Takahashi et al. |

FOREIGN PATENT DOCUMENTS

| | | | |
|---|---|---|---|
| JP | 2007-044914 | A | 2/2007 |
| JP | 2011-083950 | A | 4/2011 |
| WO | WO 2016/083410 | A1 | 6/2016 |

OTHER PUBLICATIONS

European Search Report for European Patent Application No. 19203096, dated Mar. 3, 2020.

*Primary Examiner* — Luis A Gonzalez

(74) *Attorney, Agent, or Firm* — Birch, Stewart, Kolasch & Birch, LLP

(57) ABSTRACT

An air fan assembly includes a suction box including a wall having an open area distributed across the wall. The suction box is configured to contain an underpressure on an inner side of the wall, so as to cause a cut sheet to adhere to a perforated transport belt. An impingement unit is configured to expel air supplied thereto towards the perforated transport belt. An air fan is arranged to create and maintain the underpressure in the suction box and to supply the air to be expelled by the impingement unit via an air outlet of the suction box. A first valve is arranged upstream of the air fan for conditionally admitting an additional air flow into the suction box. An inkjet printer and a method of operating the air fan assembly include the air fan assembly.

18 Claims, 2 Drawing Sheets

FAN ASSEMBLY FOR A CUT SHEET INKJET PRINTER, CUT SHEET INKJET PRINTER AND METHOD FOR OPERATING A FAN ASSEMBLY FOR A CUT SHEET INKJET PRINTER

CROSS-REFERENCE TO RELATED APPLICATIONS

This application claims priority under 35 U.S.C. § 119 to Application No. 19203096.3, filed in Europe on Oct. 14, 2019, the entirety of which is expressly incorporated herein by reference.

BACKGROUND OF THE INVENTION

1. Field of the Invention

The present invention generally pertains to a fan assembly including a suction box and an impingement unit, to a printer, in particular a cut sheet inkjet printer comprising such a fan assembly, as well as to a method for operating such a fan assembly.

2. Background of the Invention

Cut sheet inkjet printers are a type of inkjet printer which process individually cut sheets by ejecting ink out of a nozzle plate of a print head onto sheets of a medium, usually transported by a belt. Typically, inkjet printer ink is water-based, although other types of ink may be used.

Depending on the type of medium, for example paper, of the cut sheet and on the type of ink, the use of a dryer is often necessary for drying the ink ejected on the cut sheet before the cut sheet is transported further away. In this way, fouling of the interior of the inkjet printer by undried ink spatters or undesired running of the undried ink within the printed image can be reduced or avoided. Moreover, in order to make the cut sheets adhere to a transport belt (or conveyor belt) for transporting the cut sheets, often a vacuum transport belt is used. Vacuum transport belts are perforated and run over an also perforated vacuum box, in which an underpressure with respect to the sheet transport side of the transport belt is maintained. In this way, the cut sheets are gently drawn to and adhered to the transport belt and are in this way retained in their position on the transport belt throughout their processing by the inkjet printer.

Often, another requirement is present with water-based inkjet printers. It is desired that the vacuum box not only holds the cut sheets in place, but that it also prohibits wet sheets which have just been covered with ink from starting to cockle within a dryer unit of the inkjet printer. If the vacuum is used in this way not only for cut sheet holding but also for preventing cockling, i.e. wet media deformation, of the sheet, a minimum vacuum requirement for the vacuum underpressure has to be met.

One of the issues with such a system is that when only small cut sheets of the medium are being transported by the transport belt, a comparatively large surface area of the perforated transport belt is uncovered so that a comparatively high air flow has to be present within the vacuum box in order to have enough underpressure, so that the suction force is strong enough to retain the cut sheets. On the other hand, when large cut sheets are transported which cover most of the perforated transport belt, a high underpressure (high pressure differential to the atmosphere pressure) may, because of the perforations of the transport belt being mostly covered, result in a suction force being applied to the transport belt itself, which makes transport belt movement and control more difficult and may add undesired friction points and the like. Precise and accurate control of the vacuum underpressure is therefore desired.

Similarly, for drying, hot air impingement is used, that is, air is heated and expelled (impingement) onto the freshly printed cut sheets of the medium for drying. Dryer units are therefore also designated as "impingement units." Depending upon the media type, more or less, or even no air impingement is desired. For example, when the medium is very slowly absorbent, hot air impingement may cause ink ejected onto the surface of such a medium to run, or, in other words, the expelled hot air may blow ink droplets across the surface of the medium. Thus, also precise and accurate control of the air impingement, in particular its flow, is desirable.

In the background art, hot air impingement systems and the vacuum box have been designed and implemented as separate sub-systems, which require a lot of space and comprise a large number of individual parts which have to be provided and fitted, thus increasing costs of the inkjet printer itself.

SUMMARY OF THE INVENTION

It is therefore an object to solve the problem described above by providing a fan assembly for a cut sheet inkjet printer, an inkjet printer and a method for operating a fan assembly for a cut sheet inkjet printer with increased versatility, reduced costs and reduced space requirements.

This object is solved by the subject-matter of the independent claims. Advantageous embodiments, refinements and variants of embodiments are presented in the depending claims.

Thus, according to a first aspect of the invention, a fan assembly for a cut sheet inkjet printer is provided, comprising: a suction box comprising a wall having an open area distributed across the surface of the wall, e.g. a perforated plate, the total open area ranges from 0.5% to 5%, preferably from 1%-2%, wherein the suction box is configured to contain an underpressure on an inner side of the wall, so as to cause a cut sheet to adhere to a perforated cut sheet transport belt moveable along the wall; an impingement unit configured to expel air towards the perforated cut sheet transport belt; and an air fan arranged to create and maintain the underpressure in the suction box and to supply the air to be expelled by the impingement unit via an air outlet of the suction box in fluid connection with an air inlet of the air fan and via an air outlet of the air fan in fluid connection with an air inlet of the impingement unit, wherein a first valve is arranged upstream of the air fan for conditionally and/or selectively admitting an additional air flow into the suction box.

Alternatively, the wall having an open area distributed across the surface of the wall may consist of an arrangement of small transport wheels or ball bearings or rollers, arranged such that the arrangement forms a wall with an open area in the above disclosed preferred range, said wall providing smooth transport of a perforated belt across the suction box. The additional advantage of this embodiment is that the transport of the perforated belt across the suction box is virtually frictionless, leading to less wear of the perforated belt.

Alternatively, the perforated belt may be a mesh belt with a very open structure (>30%).

One basic idea of the present invention is thus to put an air fan of an air fan assembly of an inkjet printer to double use: first, to remove air from a suction box in order to create and maintain an underpressure therein, and second in order to provide air to an impingement unit.

The basic idea as presented herein has several advantages. Air fans are comparatively expensive in production and maintenance and preferably only a single air fan is used in the described fan assembly. However, the idea is also extended to improving systems wherein at least one fan has been dedicated to the impingement unit and at least one fan has been dedicated to the suction box and thus to reduce the total number of fans. For example, two fans may be used instead of three or four air fans in original construction designs, or three fans may be used instead of four, five or six air fans in existing construction designs. One of the main ideas is therefore combining a fan dedicated to the suction box (or: vacuum fan) and an air fan dedicated to the impingement unit (or air impingement fan) into one single air fan.

The suction box may also be designated as a vacuum box. Preferably, the impingement unit is also configured to, in particular selectively, heat air in order to expel heated air. In variants, a pre-heating unit may be arranged additionally or even alternatively to the heater of the impingement unit.

In variants, a plurality of air fans may be provided wherein each of the plurality of air fans is assigned not only to the impingement unit or to the suction box but instead each of which is functioning both for creating/maintaining the underpressure in the suction box as well as for providing an air flow for the impingement unit.

By using the first valve as a regulation valve for the underpressure on the inner side of the suction box, several advantages are achieved: First of all, a vacuum pressure (or underpressure) may be maintained as always constant. Therefore, movement of the transport belt is easier to control and more constant. Second, the underpressure does not rise (in the sense of decreasing further with respect to the ambient pressure) any longer when the cut sheets of the media cover the transport belt which would otherwise lead to friction and wear of the transport belt by the transport belt being drawn towards the suction box out of a nominal (i.e. preferred) operating position. Third, the flow from the suction box towards the air fan is always constant.

In some advantageous embodiments, refinements or variants of embodiments, the fan assembly comprises a second valve arranged downstream of the air fan for selectively reducing or increasing the air flow from the air fan to the impingement unit in order to control the flow of (preferably heated) air expelled from the impingement unit. In this way, the amount (or flow) of air expelled from the impingement unit can be controlled separately from the underpressure within the suction box. In particular, the rotation of the air fan can be sped up for increasing the underpressure, while at the same time the second valve is opened wider for keeping the flow of air from the impingement unit constant or even decreasing it.

Conversely, the rotation of the air fan can be slowed down in order to decrease the underpressure in the suction box (i.e. increasing the pressure therein closer towards the ambient pressure) when at the same time the second valve may be closed further or completely in order to direct the complete air flow from the air fan to the impingement unit to be expelled towards the cut sheet transport belt. Using the controllable settings and design specifications of the first valve, the air fan and the second valve, a very accurate and precise control of both the underpressure in the suction box as well as the flow of heated air from the impingement unit can be achieved.

In some advantageous embodiments, refinements or variants of embodiments, the second valve is controllable by a second valve control signal for controllably reducing the air flow from the air fan to the impingement unit. As has been described in the previous paragraph, this allows more accurate control of flow of air from the impingement unit. The second valve control signal may originate from a print controller of the cut sheet inkjet printer.

In some advantageous embodiments, refinements or variants of embodiments, the second valve is a three-way valve comprising a valve inlet for receiving an air flow from the air fan, a first valve outlet leading to the impingement unit and a second valve outlet leading to the surroundings (i.e. to the exterior) of the fan assembly. In this way, the second valve can be configured to passively regulate, or to actively regulate based on the second valve control signal, how much of the airflow from the air fan is directed to the impingement unit for expelling it onto the transport belt and how much of the air flow is diverted to the surroundings of the fan assembly. Preferably, the second valve is switchable between the first valve outlet and the second valve outlet, and the first valve outlet (including impingement inlet and impingement unit) and the second valve outlet have equal resistance. Switching such a valve from one valve outlet to the other therefore advantageously does not influence the underpressure in the suction box.

In some advantageous embodiments, refinements or variants of embodiments, the first valve is a passive valve, which is configured to conditionally admit the additional airflow into the suction box on the condition that the underpressure in the suction box exceeds a predefined threshold (becomes too low with respect to the ambient pressure).

In some advantageous embodiments, refinements or variants of embodiments, the first valve is controllable by a first valve control signal for controllably admitting the additional airflow into the suction box. In this way, an even more precise control of the underpressure in the suction box is possible. For example, as the size of the cut sheets is usually known in order to configure the transport path (including the cut sheet transport belt) of the printer accordingly, the first valve control signal may be based on properties of the cut sheets, in particular on their area (i.e. their dimensions). Preferably, the first valve control signal is generated based on the second valve control signal and/or vice versa such that the precise interrelation between the first and the second valve can be carefully balanced to produce the desired airflow from the impingement unit as well as the desired underpressure in the suction box.

In some advantageous embodiments, refinements or variants of embodiments, the first valve is arranged within the suction box. In this way, the underpressure within the suction box is most directly controllable or regulatable.

In some advantageous embodiments, refinements or variants of embodiments, a pre-heating unit is arranged between the suction box and the air fan (i.e. in the flow between the suction box and the air fan) for pre-heating the air drawn from the suction box towards the air fan. In this way, the air fan acts as an air mixer, mixing colder and warmer air parts into a more uniform air temperature. Additionally, moisture condensation around the air fan may be reduced and/or the airflow being directed towards the impingement unit is already pre-heated so that an optional heater (or heating unit) of the impingement box, which may be provided for heating the air to be expelled by the impingement unit, can be provided with lower power specifications, which may be more energy-efficient.

According to a second aspect of the present invention, a cut sheet inkjet printer comprising a fan assembly according to any embodiment of the first aspect of the invention is provided. The cut sheet inkjet printer may in particular be a water-based inkjet printer.

According to some advantageous embodiments, refinements or variants of embodiments, the printer comprises a fan assembly with a second valve controllable by the second valve control signal for controllably reducing the airflow from the air fan to the impingement unit. The printer may further comprise a first valve control module configured to generate the first valve control signal for controlling the first valve and/or may further comprise a second valve control module configured to generate the second valve control signal for controlling the second valve. The first valve control module and/or the second valve control module may be part of a print controller or may be implemented separately. The print controller, the first valve control module and/or the second valve control module may be implemented as hardware and/or software, and may in particular be implemented by program code run by a computing device.

The computing device may be realized as any device, or any means, for computing, in particular for executing software, an app, or an algorithm. For example, the computing device may comprise at least one processing unit such as at least one microcontroller, at least one central processing unit, CPU, and/or at least one graphics processing unit, GPU, and/or at least one field-programmable gate array, FPGA, and/or at least one application-specific integrated circuit, ASIC and/or any combination of the foregoing. The computing device may further comprise a working memory operatively connected to the at least one processing unit and/or a non-transitory memory operatively connected to the at least one processing unit and/or the working memory. Some, or even all, modules of the system may be implemented by a cloud computing platform.

In some advantageous embodiments, refinements or variants of embodiments, the printer comprises a first valve control module for generating a first valve control signal for controlling the first vale.

In some advantageous embodiments, refinements or variants of embodiments, the printer comprises a second valve control module for generating a second valve control signal for controlling the second valve.

According to a third aspect, the invention provides a method for operating the fan assembly according to any embodiment of the first aspect of the present invention and/or a method for operating the cut sheet inkjet printer according to any embodiment of the second aspect of the present invention.

The method comprises at least a step of controlling the air fan to create and maintain the underpressure in the suction box and to further control the air fan to supply the air to be expelled by the impingement unit.

The method may further comprise a step of controlling the second valve for selectively reducing the airflow from the air fan to the impingement unit in order to control the flow of (preferably heated) air expelled from the impingement unit. The method may also comprise a step of controlling the first valve for admitting the additional airflow into the suction box.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
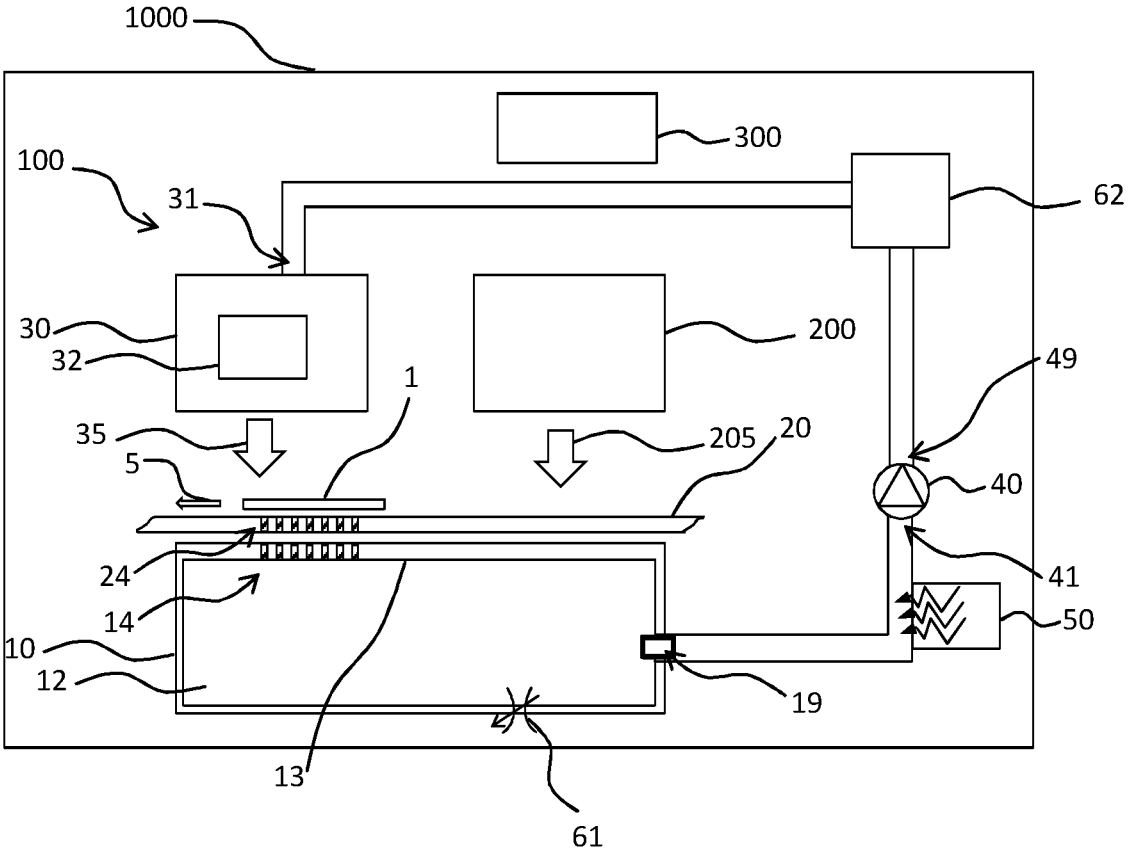
FIG. 1 schematically illustrates a fan assembly for a cut sheet inkjet printer according to an embodiment of the first aspect of the present invention as well as a cut sheet inkjet printer according to an embodiment of the second aspect of the present invention.

The present invention will now be described with reference to the accompanying drawings, wherein the same reference numerals have been used to identify the same or similar elements throughout the several views, and in some instances throughout the several embodiments. The numbering of method steps is, if not explicitly or implicitly described otherwise, not intended to necessarily indicate a time ordering of steps. In particular, several steps may also be performed simultaneously.

FIG. 1 schematically illustrates a fan assembly 100 for a cut sheet inkjet printer 1000 according to an embodiment of the first aspect of the present invention, as well as a cut sheet inkjet printer 1000 according to an embodiment of the second aspect of the present invention.

The fan assembly 100 includes a suction box 10 comprising a plate 13 perforated by perforations 14 for allowing air to pass through the plate 13. The suction box comprises an outlet 19 and a first valve 61. The fan assembly further includes an air fan 40, a second valve 62, an impingement unit 30 and optionally a pre-heating unit 50. All elements are in fluid connection as shown in FIG. 1. The suction box 10 is configured to contain an underpressure (or vacuum) on an inner side 12 of the perforated plate 13 with respect to an outer side of the perforated plate 13. In this way, when a perforated transport belt 20 (i.e. a transport belt 20 comprising perforations 24) is moved along the perforated plate 13, air is sucked through the perforations 14, 24 through the perforated plate 13 and the perforated transport belt 20 into the suction box 10. Cut sheets 1 of a medium, for example paper, are thus sucked onto (or adhered to) the perforated transport belt 20 so that they maintain their current position. The perforated transport belt 20 may be regarded as a part of the fan assembly 100 or may be regarded as a part of the printer 1000 separate from the fan assembly 100.

The inkjet printer 1000 comprises the fan assembly 100, a print head 200, a controller 300 and a transport belt 20. The print head 200 is arranged such that it can eject ink 205 (e.g. water-based ink) onto a cut sheet of a medium 1 transported by the transport belt 20 in a transport direction 5.

As shown in FIG. 1, the suction box 10 further comprises a first valve 61 configured to conditionally and/or selectively admit an additional air flow into the suction box 10, i.e., to admit the additional air flow when certain conditions are fulfilled. The additional air flow is additional in the sense that it is additional to the air flow through the perforations 14 into the suction box 10. Alternatively, the first valve 61 may provide the same functionality but may be provided upstream of the suction box 10.

The first valve 61 may be a passive valve configured to conditionally admit the additional air flow into the suction box 10 on the condition that the underpressure in the suction box 10 exceeds a predefined threshold. This may in particular occur if a comparatively large sheet of a medium covers a comparatively large number of the perforations 14. Alternatively, the first valve 61 may be controllable by a first valve control signal for controllably admitting the additional air flow into the suction box 10.

In order to create and maintain the underpressure in the suction box 10, the fan assembly 100 comprises an air fan 40. An outlet 19 of the suction box 10 is fluidically connected to the air fan 40 so that the air fan 40 is able to create an air flow out of the suction box 10 for creating/maintaining the underpressure therein. Fluidically connected herein means that a fluid (here: air) can flow between the suction box 10 and the air fan 40, in particular in a guided way. The outlet 19 may be connected to the air fan 40 e.g. by way of an enclosed air duct or manifold or the like.

The fan assembly 100 further comprises an impingement unit 30 configured to expel air supplied to the impingement unit 30 towards the perforated transport belt 20, such that the air 35 (preferably hot air) can impinge upon sheets 1 transported by the perforated transport belt 20 away from the print head 200. In other words, the impingement unit 30 is arranged, in the transport direction 5, downstream of the print head 200. The suction box 10 and the perforations 14 in the plate 13 may extend at least over an area of the transport belt 20 under the impingement unit 30 (in order to prevent cockling), preferably in addition at least over an area under the print head 200 (in order to keep the cut sheets 1 in place during and after the printing). The transport belt 20 preferably comprises perforations 24 along its whole length so that any section of its length is capable to keep cut sheets 1 in place due to the underpressure in the suction box 10. In the presently described example, the impingement unit 30 comprises a heater 32 for selectively heating the air supplied by the air fan 40.

In an embodiment, the paper transport can be segmented in order to provide different vacuum forces in different sections of the printer, e.g. a first belt (and first suction box) arranged underneath the printhead 200 and a second belt (and second suction box) underneath the impingement unit 30. All thinkable arrangements are within the scope of the present invention.

The air fan 40 is further configured to supply the air to be heated and expelled to the impingement unit 30 by transporting the air from the outlet 19 of the suction box 10 towards the impingement unit 30. In other words, an air inlet 41 of the air fan 40 is arranged in fluid connection (or fluidically) with the outlet 19 of the suction box 10 and an air outlet 49 of the air fan 40 is arranged in fluid connection with an inlet 31 of the impingement unit 30.

Preferably, the fan assembly 100 further comprises a second valve 62 arranged downstream of the air fan 40 for selectively reducing the air flow from the air fan 40 to the impingement unit 30 in order to control the flow of heated air 35 expelled from the impingement unit 30. In other words, the amount, or flow, of the heated air 35 from the impingement unit 30 can by (actively and/or passively) controlled by way of the second valve 62.

In some variants, the second valve 62 may be a passively regulated (or regulating) valve such that the air flow from the air fan 40 to the inlet 31 of the impingement unit 30 does not exceed a predefined threshold.

Preferably, however, the second valve 62 is controllable by a second valve control signal for controllably reducing the air flow from the air fan 40 to the impingement unit 30. In some variants, the air fan 40 may be controllable by an air fan control signal not only for activation/deactivation but also for activation to a specific degree (or rotational speed).

Figure 2:
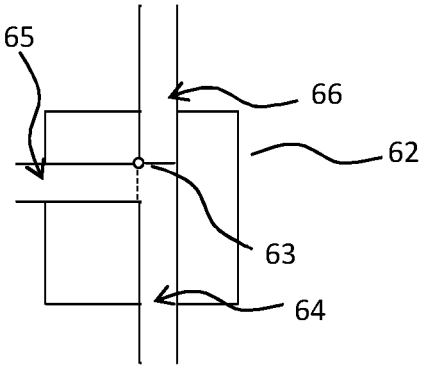
FIG. 2 schematically illustrates optional details of the second valve of the fan assembly of FIG. 1.

It is also preferred that the second valve 62 is configured as is illustrated with respect to FIG. 2. FIG. 2 schematically shows the second valve 62 in more detail. Therein, it is shown how the second valve 62 may be a three-way valve comprising a valve member 63, a valve inlet 64 for receiving an air flow from the air fan 40, a first valve outlet 65 leading to the impingement unit 30 and a second valve outlet 66 leading to the surroundings (i.e. exterior) of the fan assembly 100, or even out of the cut sheet printer 1000. The second valve 62 is switchable between the first valve outlet 65 and the second valve outlet 66, and the first valve outlet 65 and the second valve outlet 66 preferably have equal resistance. In this way, the air flow from the air fan 40 is not impacted when the second valve 62 switches from the first valve outlet 65 to the second valve outlet 66 or vice versa.

Referring again to FIG. 1, the second valve 62 is preferably controllable by a second valve control signal for controllably reducing the air flow from the air fan 40 to the impingement unit 30. For example, the second valve 62 shown in FIG. 2 may be controlled to operate the valve member 63 such that a certain percentage of the air flow from the valve inlet 64 is directed toward the first valve outlet 65 and the remainder of the air flow from the valve inlet 64 is directed towards the second valve outlet 66. Thus, the air flow expelled from the impingement unit 30 is the same as the air flow entering the first valve outlet 65. This air flow entering the first valve outlet 65 can be controlled to amount to any value between zero, when the first valve outlet 65 is completely closed, as a minimum, up to the complete air flow entering the valve inlet 64, when the second valve outlet 66 is completely closed, as a maximum. Said maximum may be further controlled via the air fan control signal, i.e. by controlling the rotational speed of the air fan 40.

As an advantageous option, a pre-heating unit 50 may be arranged for pre-heating the air removed from the suction box 10 before it enters the impingement unit 30 in which the air will optionally be further heated by the internal heater 32 of the impingement unit 30 to a desired temperature. As shown in FIG. 1 schematically, the pre-heating unit 50 may advantageously be positioned between suction box 10 and the air fan 40 (more specifically between the outlet 19 of the suction box 10 and the air inlet 41 of the air fan 40) so as to pre-heat the air removed from the suction box 10 before it enters the air fan 40. In this way, the fan acts like an air mixer that reduces temperature variation in the air flowing through the heater, which heater does not homogeneously heat the passing air. Additionally, an air temperature favorable for the operation of the air fan 40, for example due to reduced condensation and the like, can be provided at the air fan 40.

Moreover, the internal heater 32 of the impingement unit 30 may be realized with comparatively smaller dimensions as the air entering it is already pre-heated. Moreover, the already provided air ducts between the outlet 19 of the suction box and the inlet 41 of the air fan 40 can be used for efficiently pre-heating the air. In some variants, the impingement unit 30 does not comprise an (internal) heater 32, and the pre-heating unit 50 is the only measure for heating the air to be expelled by the impingement unit 30. In this way, the impingement unit 30 may be designed and realized with smaller dimensions.

Figure 3:
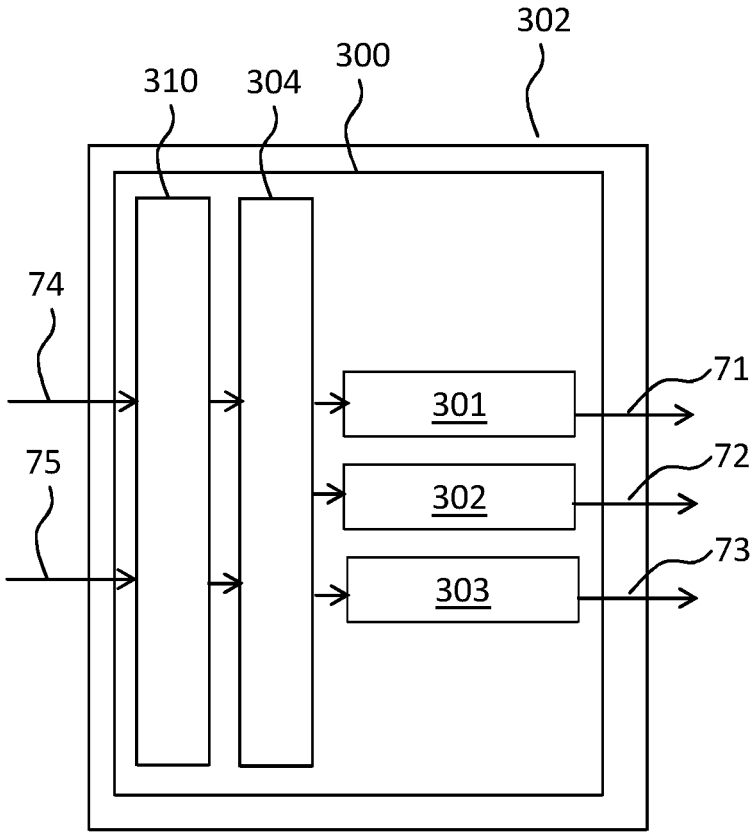
FIG. 3 schematically illustrates optional details of the controller of the fan assembly or of the inkjet printer of FIG. 1.

FIG. 3 schematically shows possible details of the controller 300 of the printer 1000.

The controller 300 may be realized as software modules implemented by a computing device 302 that may be part of the inkjet printer 1000. The controller 300 may be integrated into a print controller of the inkjet printer 1000, wherein the print controller controls the printing on the cut sheets 1 by the print head 200, the transporting of the cut sheets 1 throughout the inkjet printer 1000 and the like. The controller 300 may also be provided as a separate controller of the air fan assembly 100 and may also be realized as part of the air fan assembly 100.

The controller 300 preferably comprises a first valve control module 301 configured to generate the first valve control signal 71 (in case the first valve 61 is an actively controllable valve), a second valve control module 302 configured to generate the second valve control signal 72 (in case the second valve 62 is an actively controllable valve), and/or an air fan control module 303 configured to generate the air fan control signal 73. Any or all of these modules 301, 302, 303 may be implemented as a software module and/or by hardware. It should be understood that, for variants of the fan assembly 100 in which any of the first or second valves 61, 62 are realized as passive valves, the controller 300 will not generate the corresponding valve control signals 71, 72. Still, by designing the resistances of the passive valves and by controlling the air fan 40 via the air fan control signal 73, a suitable range of air flow values of the impingement unit 30 for a specific application can be provided.

The controller 300 may be configured to receive, via an input interface 310, a suction requirement signal 74 indicating a desired suction force to be generated by the suction box 10 and/or indicating details of a cut sheet 1 intended to be maintained in place on the transport belt 20 by the underpressure and/or details of the print job performed thereon. For example, the suction requirement signal 74 may comprise information about a type of medium of the cut sheet 1 (in particular area, but optionally or alternatively thickness, weight, porosity, tensile strength, tendency to cockle and/or the like), a type of ink 205 used for printing thereon, and/or the like. Using e.g. a lookup-table or a trained machine learning algorithm, based on these pieces of information, the desired underpressure in the suction box 10 may be determined by the controller 300.

The controller 300 may further be configured to receive, via the input interface 10, an impingement requirement signal 75 indicating a desired flow of (heated) air 35 to be expelled by the impingement unit 30 and/or details of a cut sheet 1 intended for air impingement and/or details of the print job performed thereon. For example, the impingement requirement signal 75 may comprise information about a type of medium of the cut sheet 1, a type of ink 205 used for printing thereon, an image resolution of an image printed thereon and/or the like. Using e.g. a lookup-table or a trained machine learning algorithm, based on these pieces of information, the desired flow of hot air 35 may be determined by the controller 300.

The controller 300 may further comprise a calculating module 304 for performing intermediate calculations for determining the first valve control signal 71, the second valve control signal 72 and/or the air fan control signal 73 based on the suction requirement signal 74 and/or the impingement requirement signal 75.

For example, the calculation module 304 may be configured to determine, based on the suction requirement signal 74, a desired suction force strength to be exerted by the suction box 10 and/or a value for the underpressure in the suction box 10, preferably based on the type of medium of the cut sheet 1, in particular based on its area. Alternatively, or additionally, the calculation module 304 may calculate a corresponding control parameter for the first valve 61, the second valve 62 and/or the air fan 40 based thereon, such as a valve opening ratio, a valve member position, a rotational speed of the air fan 40 and/or the like. The modules 301-303 may then generate, based on the calculated control parameter(s), the first valve control signal 71, the second valve control signal 72 and/or the air fan control signal 73.

For example, if a very high flow of hot air 35 from the impingement unit 30 is desired, the air fan 40 may have to be controlled via the air fan control signal 73 to run at its highest setting, or highest rotational speed. If, at the same time, comparatively large cut sheets 1 are transported by the transport belt 20, which cover a large percentage of the perforations 24 in the transport belt 20, the combination of the highest setting of the air fan 40 and the large number of covered perforations 24 would result in a large increase in the underpressure within the suction box 10. This in turn may result in the transport belt 20 itself being drawn towards the suction box 10 which may interfere with the smooth running of the transport belt 20. In that case, the calculation module 304 may be configured to concurrently determine one or more control parameter(s) for the first valve 61 such that the underpressure within the suction box 10 is maintained at a desired level.

Although different operations have been, for ease of understanding, described herein as separate steps performed by separate modules 301, 302, 303, 304, it shall be understood that the described modules 301, 302, 303, 304 may be partially or completely integrated in one another, in particular when they are all implemented as software run by a computing device. Especially the modules 301-303 and the calculating module 304 have been described as separate modules but may also be realized as one piece of software run, as part of the controller 300, by the computing device 302.

Similarly, although for ease of understanding the suction requirement signal 74 and the impingement requirement signal 75 have been treated as different signals, they may be realized as one and the same signal, as e.g. an input information signal comprising both (characteristics of) the suction requirement signal 74 and the impingement requirement signal 75, and may in particular be carried by the same physical (wire-bound or wireless) carrier.

Figure 4:
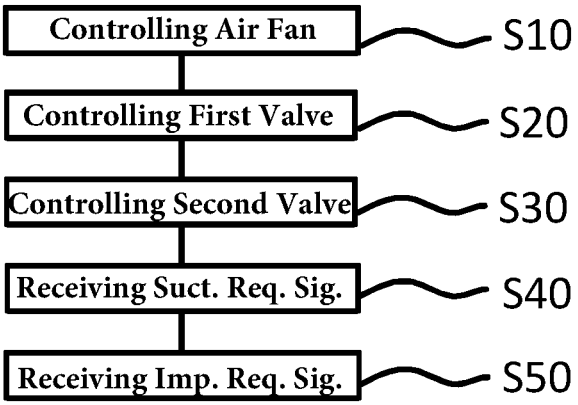
FIG. 4 is a schematic flow diagram for illustrating a method according to an embodiment of the third aspect of the present invention.

FIG. 4 is a schematic flow diagram illustrating a method according to an embodiment of the third aspect of the present invention, i.e. a method for operating the fan assembly 100 according to any embodiment of the first aspect of the present invention, in particular the fan assembly 100 as has been described with respect to FIG. 1 to FIG. 3.

The method comprises a step of controlling S10 the air fan 40 to create and maintain the underpressure in the suction box 10 and to supply the air to be (heated and) expelled to the impingement unit 30, for example via the air fan control signal 73 generated by the controller 300, in particular by the air fan control module 303. Thus, the controlling S10 of the air fan 40 may comprise generating the air fan control signal 73, e.g. as has been described with respect to FIG. 3.

The method may further comprise a step of controlling S20 the first valve 61 for admitting additional air flow into the suction box 10 in order to maintain or decrease a current level of underpressure, for example via the first valve control signal 71 generated by the controller 300, in particular by the first valve control module 301. Thus, the controlling S20 of the first valve 61 may comprise generating the first valve control signal 71, e.g. as has been described with respect to FIG. 3.

The method may further comprise, when the fan assembly 100 comprises a second valve 62 as described in the foregoing, a step of controlling S30 the second valve 62 to selectively reduce the air flow from the air fan 40 to the impingement unit 30 in order to control the flow of air 35 expelled from the impingement unit 30, for example via the second valve control signal 72 generated by the controller 300, in particular by the second valve control module 302. Thus, the controlling S30 of the second valve 62 may comprise generating the second valve control signal 72, e.g. as has been described with respect to FIG. 3.

As has been described with respect to FIG. 3, the method may also comprise a step of receiving S40 a suction requirement signal 74 and/or a step of receiving S50 an impingement requirement signal 75. The steps S10, S20 and S30 may be performed based on the received suction requirement signal 74 and/or the received impingement requirement signal 75.

It should be understood that the method of FIG. 4 may also be used to operate a cut sheet inkjet printer 1000 according to an embodiment of the second aspect of the present invention, in particular the cut sheet inkjet printer 1000 as has been described with respect to FIG. 1 to FIG. 3. The method may therefore also be designated as a method for operating a cut sheet inkjet printer 1000.

While detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language).

It will be evident that the described embodiments may be varied in many ways. All such modifications as would be evident to one skilled in the art starting from what is explicitly described are intended to be included.

One basic idea of the invention may be summarized as follows: an air fan of an air fan assembly of an inkjet printer is put to double use: first, to remove air from a suction box in order to create and maintain an underpressure therein, and second in order to provide air to an impingement unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fan assembly for a cut sheet inkjet printer, comprising:

a suction box comprising a wall having an open area distributed across a surface of the wall, wherein the suction box is configured to contain an underpressure on an inner side of the wall, so as to cause a sheet to adhere to a perforated transport belt moveable along the wall;

an dryer configured to expel air supplied to the dryer towards the perforated transport belt;

an air fan arranged to create and maintain the underpressure in the suction box and to supply the air to be expelled to the dryer via an air outlet of the suction box in fluid connection with an air inlet of the air fan and via an air outlet of the air fan in fluid connection with an air inlet of the dryer;

a first valve arranged upstream of the air fan for conditionally and/or selectively admitting an additional air flow into the suction box; and a second valve arranged downstream of the air fan for selectively reducing an air flow from the air fan to the dryer in order to control a flow of air expelled from the dryer, wherein the second valve is controllable by a second valve control signal for controllably reducing the air flow from the air fan to the dryer, and wherein the second valve is a three-way valve comprising a valve inlet for receiving the air flow from the air fan, a first valve outlet leading to the dryer and a second valve outlet leading to surroundings of the fan assembly.

2. The fan assembly of claim 1, wherein the second valve is switchable between the first valve outlet and the second valve outlet, and wherein the first valve outlet and the second valve outlet have equal resistance.

3. The fan assembly of claim 1 wherein the first valve is a passive valve configured to conditionally admit the additional air flow into the suction box on the condition that the underpressure in the suction box exceeds a predefined threshold.

4. The fan assembly of claim 1, wherein the first valve is controllable by a first valve control signal for controllably admitting the additional air flow into the suction box.

5. The fan assembly of claim 1, wherein the first valve is arranged within the suction box.

6. The fan assembly of claim 1, wherein a pre-heater is arranged between the suction box and the air fan for preheating air drawn from the suction box towards the air fan.

7. A cut sheet inkjet printer comprising the fan assembly according to claim 1.

8. The cut sheet printer of claim 7, further comprising a second valve control module configured to generate the second valve control signal for controlling the second valve.

9. The cut sheet printer of claim 7, wherein the first valve is controllable by a first valve control signal for controllably admitting the additional air flow into the suction box, wherein the first valve is arranged within the suction box, the cut sheet printer further comprising a first valve control module configured to generate the first valve control signal for controlling the first valve.

10. A method for operating the fan assembly of claim 1, comprising the steps of:

controlling the air fan to create and maintain the underpressure in the suction box and to supply the air to be expelled by the dryer; and controlling the second valve for selectively reducing the air flow from the air fan to the dryer in order to control the flow of air expelled from the dryer.

11. The method of claim 10, wherein the first valve is controllable by a first valve control signal for controllably admitting the additional air flow into the suction box, the method further comprising controlling the first valve for admitting the additional air flow into the suction box.

12. The fan assembly of claim 2, wherein the first valve is a passive valve configured to conditionally admit the additional air flow into the suction box on the condition that the underpressure in the suction box exceeds a predefined threshold.

13. The fan assembly of claim 2, wherein the first valve is controllable by a first valve control signal for controllably admitting the additional air flow into the suction box.

14. The fan assembly of claim 2, wherein the first valve is arranged within the suction box.

15. The fan assembly of claim 2, wherein a preheater is arranged between the suction box and the air fan for preheating air drawn from the suction box towards the air fan.

16. A cut sheet inkjet printer comprising the fan assembly according to claim 2.

17. The fan assembly of claim 1, wherein the dryer is an air impingement fan.

18. The fan assembly of claim 1, wherein the dryer is a hot air dryer.

* * * * *